US005115863A

United States Patent [19]

Olinger

[11] Patent Number: 5,115,863

[45] Date of Patent: May 26, 1992

[54] LOW TURBULENCE ROD GUIDE

[76] Inventor: Edward L. Olinger, 500 N. Hoyne, Fritch, Tex. 79036

[21] Appl. No.: 682,164

[22] Filed: Apr. 5, 1991

[51] Int. Cl.[5] ..... E21B 17/10

[52] U.S. Cl. ..... 166/241; 175/325

[58] Field of Search ..... 166/241, 173, 175, 176, 166/242; 175/320, 325

[56] References Cited

U.S. PATENT DOCUMENTS

| | | | |
|---|---|---|---|
| 3,399,730 | 9/1968 | Pourchot | 166/176 |
| 4,088,185 | 5/1978 | Carson | 166/241 |
| 4,787,448 | 11/1988 | Sable | 166/241 X |
| 4,809,777 | 7/1989 | Sable | 166/241 |
| 4,858,688 | 8/1989 | Edwards | 166/241 |
| 4,919,202 | 4/1990 | Clintberg | 166/241 X |

FOREIGN PATENT DOCUMENTS 3130580 4/1982 Fed. Rep. of Germany .

*Primary Examiner*—Thuy M. Bui

*Attorney, Agent, or Firm*—Alec H. Horn; Harold H. Flanders; Robert L. Price

[57] ABSTRACT

A rod guide or centralizer for a reciprocating rod string which presents minimal resistance to the axial flow of well fluids. The guide offers minimum cross section and turbulence without loss of erodible volume. The guide may be molded on or fitted with an axial slot for field installation. The guide is very long in relation to its diameter to facilitate laminar flow and a low drag coefficient.

26 Claims, 3 Drawing Sheets

LOW TURBULENCE ROD GUIDE

BACKGROUND OF INVENTION

This application relates to improvements in rod guides, centralizers or the like for sucker rods in pumping oil wells and more particularly to rod guides causing reduced drag resistance and turbulence.

As is well known, sucker rods in pumping oil wells normally extend longitudinally through the well bore or well tubing and are reciprocated therein during the pumping operation. Since most well bores are not straight, and many are purposely drilled at an angle, the rods frequently wear against or engage the walls of the tubing during reciprocation, which creates detrimental wear on the rods and tubing.

The usual apparatus for pumping oil fluids includes a pump connected to the lower end of the tubing which is reciprocated in the barrel of the pump by the string of sucker rods. The sucker rods, or rod string, are connected to a reciprocating means for alternately pulling the string upward and then allowing the string to be moved downwardly by gravity.

Since the weight of the pumping rod string provides the force necessary to cause well fluids to flow upwardly through the tubing, if the resistance to movement of the string causes the rod string to move downward relatively slowly, the rate of production of well fluids is reduced. In addition, if the lower end portions of the rod string offer a relatively great resistance in downward movement, the weight of the upper portion of the rod string may place portions of the rod string under great compression loads, which tends to cause bending or bowing of the rod and increased abrasion against the internal surfaces of the tubing. If resistance to movement is unnecessarily high, a greater amount of energy is required to lift the string and much work is lost to fluid friction. If fluid turbulence is high, there is increased wear from particles in the fluid abrading against the rod.

OBJECTS OF THE INVENTION

It is an object of the present invention to provide a rod guide for sucker rods of a rod string which will hold the rods in central longitudal alignment in the tubing while presenting minimal resistance to the axial flow of fluids.

Another object of the present invention is to provide rod guides on the rods which decreases turbulence and drag resistance and thus decreases internal abrasion of the rod.

Another object of the invention is to provide a rod guide with reduced resistance to upward flow past the rod guide without sacrificing the erodible volume available for wear.

It is another object of the present invention to provide a rod guide approximating laminar flow thereby reducing turbulence in the upward fluids.

It is yet another object of the present invention to provide a rod guide which provides a high fluid bypass area without sacrificing erodible volume available for wear.

DETAILED DESCRIPTION

Figure 1:
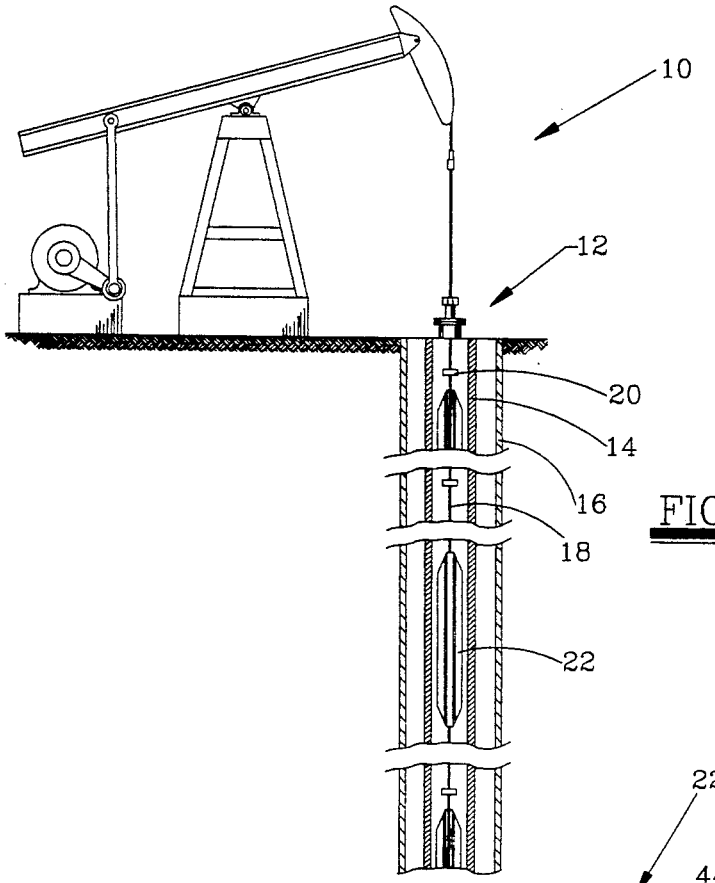
FIG. 1 is a vertical view of a well having a reciprocating rod string provided with rod guides of the present invention.

Referring now to the drawings, a pumping apparatus (10) is shown in use pumping fluids from a well (12) through a string of tubing (14) disposed within well casing (16). Connected to the pumping apparatus (10) is a string of sucker rods (18) which are connected together by a typical box and socket couplings (20).

When the pumping apparatus is on the down stroke of its reciprocating action, the string of rods (18) drop within the tubing (14) to operate a pump (not shown). A plurality of rod guides (22) of the present invention are fixedly engaged around the sucker rods at selected locations throughout the length of the rod. During this downward movement of the string of sucker rods, the well fluids are caused to flow upwardly in the tubing relative to the rod guides.

Figure 2:
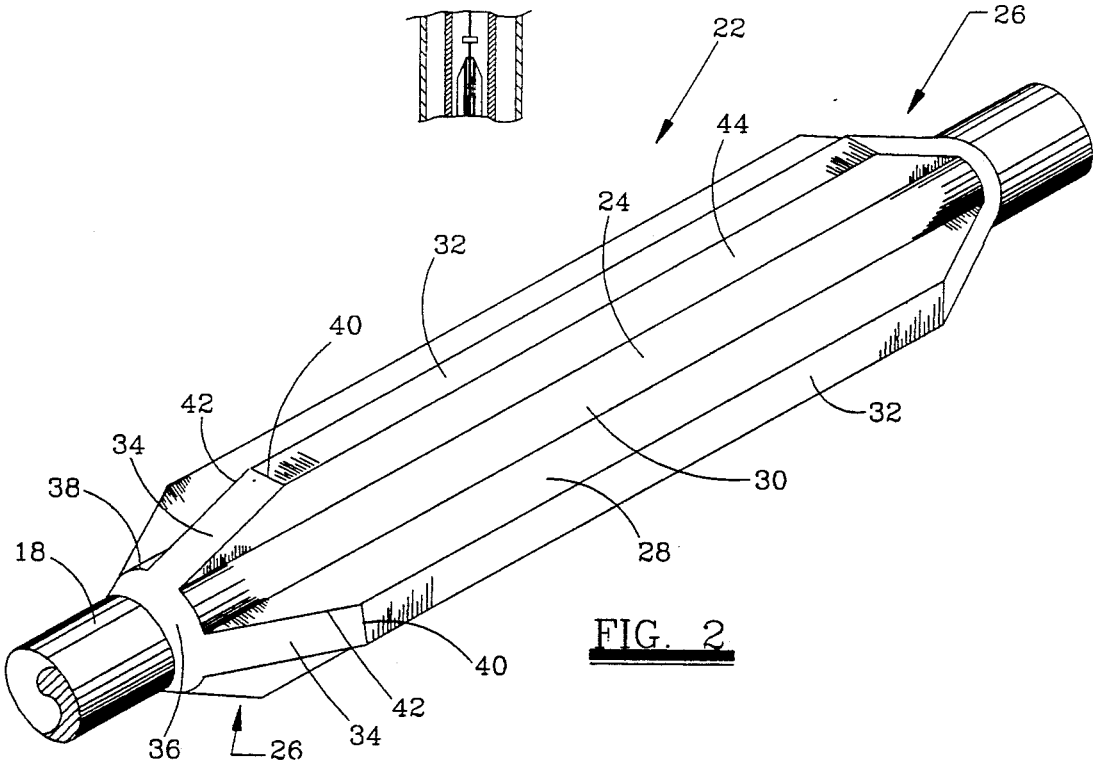
FIG. 2 is an isometric view of one embodiment of a rod guide of the present invention.

Referring now to FIG. 2, there may be seen a more detailed isometric illustration of one embodiment of rod guide (22). As may be seen, the rod guide (22) is typically composed of a polymeric material molded about a selected location along rod (18). Although many polymeric materials are suitable, presently in common use are ultra high molecular weight polyethylene, polyethylene, nylon and polyphenylene sulphide.

This substantially longitudinal rod guide is substantially coaxial with the rod and has a substantially cylindrical polymeric guide body (24) molded about the rod which carries a plurality of substantially continuous, longitudinal vanes (28) integrally molded with the body (24) and spaced circumferentially about the radially outward surface of the guide body (30) at 90° angles. Each longitudinal vane (28) extends substantially the entire length of the guide body and extends radially away from the guide body to provide a radially outside wear surface (32) for frictional engagement with the tubing (14).

It may be seen that the body (24) tapers at each terminal end of the guide to form a tapered end (36) which minimizes the fluid drag on the guide body. An incline at each terminal end of the vane forms a leading surface (34) which preferably is substantially in the same plane as the tapered terminal end (36) of the guide body. In this manner the turbulence and fluid drag from the well fluids is minimized. Although it is presently preferred to have the tapered end (36) in the same plane as the leading surface, a substantially monoplanar face, having a small break or slight curve would be acceptable if other features of the present invention are incorporated. Further, it may be desirable to have the edges (38), formed by the transition between surfaces (36) and outside surface (30), and edges (40), formed by the transition of leading surfaces (34) and wear surface (32), slightly rounded to further reduce drag. A radius of curvature of about 1" has been found to be acceptable for rounding. Likewise, the edge (42), formed by the transition from leading surface (34) to the side surface (44), may be rounded to the extent in keeping with manufacturing convenience.

Figure 3:
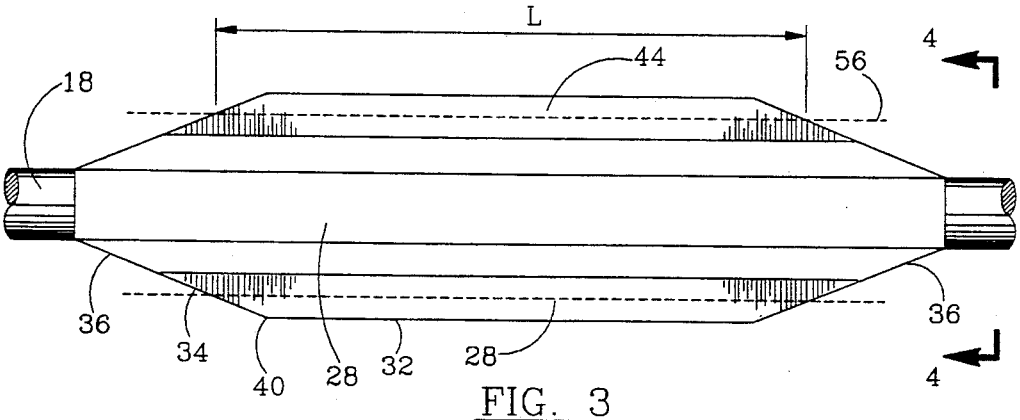
FIG. 3 is a side view of the rod guide of FIG. 1.

Referring now to FIG. 3, there may be seen a side view of the rod guide of FIG. 2. It can be seen that the tapered end (36) of the body and the leading surface (34) form a single plane which is substantially continuous from the wear surface (32) to the rod (18). It has been found desirable to have the angle of this surface substantially between 20° and 45°, with 25° to 35° more preferred.

Vane (28) has a length (L) and the vanes are circumferentially disposed about the guide body (24) to form a diameter (D). The ratio of L/D should be substantially 2.1 to 3.5 in order to decrease the turbulence and the drag coefficient. An L/D ratio of 2.2 to 3 is more preferred, with 2.7 most preferred.

Figure 4:
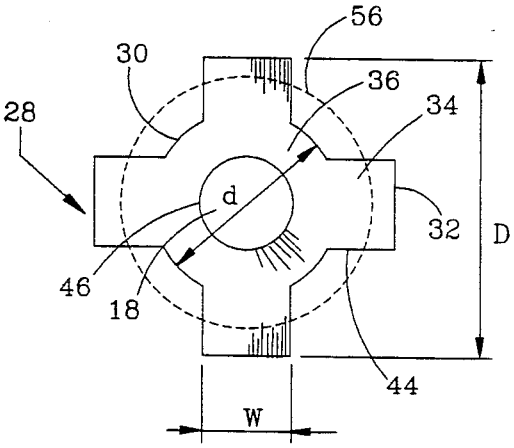
FIG. 4 is an end view taken on line 4—4 of FIG. 3.

Referring now to FIG. 4, may be seen an end view of the guide of FIGS. 2 and 3 along line 4—4. It may be seen that the rod guide is molded about the rod and is fixedly engaged about the rod by the shrink fit of the polymer body about the rod at the inward surface (46) of the guide. It may be seen that the thickness of the guide body is determined by the outer diameter (d) of the guide body about the rod. For manufacturing convenience, it has been found desirable to allow the outer diameter of the body to remain substantially constant even though the diameter of the rod (18) may vary. Accordingly, the section thickness of the body on the rod may vary from rod size to rod size. Typically a diameter (d) of about 1.125 inches has been found to be acceptable.

It is a feature of the present invention to provide a rod guide having a reduced drag force while at the same time not sacrificing erodible volume. Erodible volume is that volume of polymer on the guide which lies between the outer diameter (D) and the diameter (56) of the coupling to be protected.

Another important concept is by-pass area. By-pass area is that area between the guide and the tubing wall which is available for the flow of fluid. Naturally if the by-pass area is small, each rod guide serves as a restriction point, which unnecessarily increases the amount of energy required to pass fluids along the length of the tubing. It can be seen, therefore, that by-pass area and erodible volume may tend to oppose each other.

It is a desirable feature of the present invention that the width (W) of each vane be maintained at a thickness which permits convenient passage of fluids about the guide yet provides adequate erodible volume for wear life. The length of the vane should be about 7–14 times the width, W, to obtain the desired results in a four vane guide. A L/W ratio of 9–11 is more preferred and a ratio of about 10 is most preferred. Accordingly, a width (W) of about 0.5 to 0.625 inches has been found acceptable if four ribs are employed on a nominal 2½ inch guide wherein D equals 2.325 inches and L equal 5–7 inches.

Figure 5:
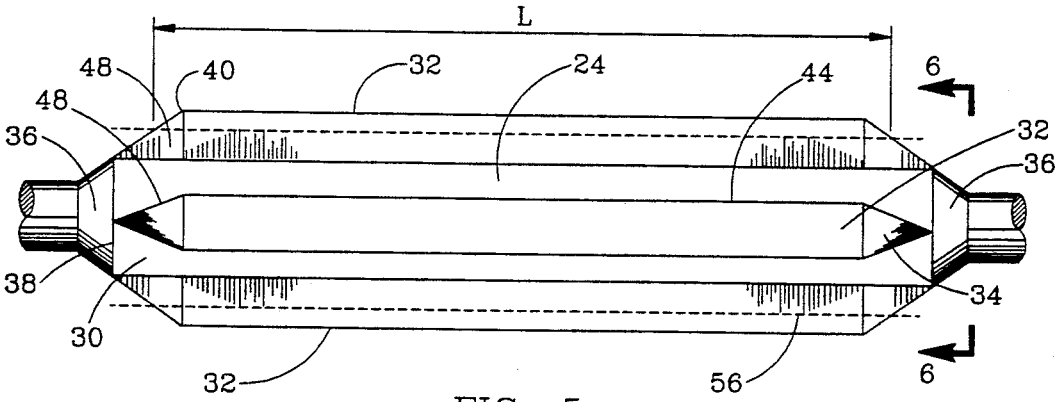
FIG. 5 is a side view of another embodiment of the rod of the present invention.

Referring now to FIG. 5, there may be seen a side view of another embodiment of the present invention. In the embodiment of FIG. 5, three vanes are employed with each vane circumferentially disposed about the guide body at 120°. The vanes (28) have at each terminal end converging side surfaces (48) which convergently taper to a point which preferrably lies in the same plane as the tapered body end (36) and leading surface (34). These convergent surfaces (48) and the downward taper of leading surface (34) forms a semi-pyramid structure which may reduce turbulence and drag even further. While it is preferred that the body taper end (36) and leading surface (34) be in the same plane, it is understood that minor discontinuities or minor curves do not substantially affect the low turbulence feature of the terminal end of the rod guide if the other features of the present invention are employed.

A guide having a taper end (36) at 25° and a leading surface of 45° was acceptable with an L/D ratio of 2.2. This produced an average angle of 32° from wear surface to rod. It should be noted that as the L/D ratio is increased, the tolerance for turbulence-creating discontinuities at the terminal end of the rod guide is increased. In practice, each vane width (W) may be greater if only three vanes are used. For a three vane guide, an L/W ratio of 5–12 provides acceptable results but an L/W ratio of 6.5–10 is more preferred and an L/W ratio of 7.5–8.5 is most preferred. A width of about 0.8 inches has been found adequate on a nominal 2½ inch diameter guide with only three vanes and an L/D ratio of 2.7.

Figure 6:
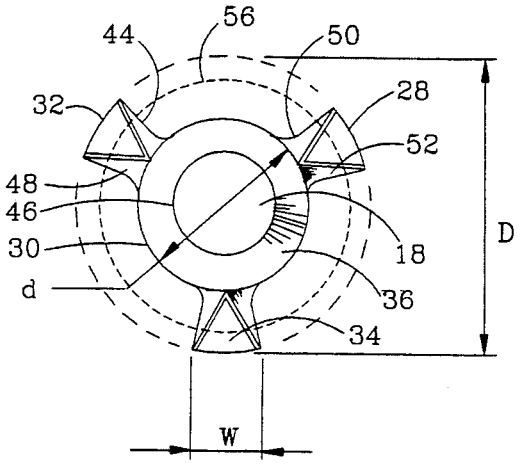
FIG. 6 is an end view taken on line 6—6 of FIG. 5.

Referring now to FIG. 6, may be seen an end view taken along line 6—6 of the guide of FIG. 5. The wear surfaces (32) of the vanes, each circumferentially spaced 120° about the guide body, establishes a diameter (D). It may be noted that wear surface (32) may be slightly curved to conform to the interior of tubing (14) and that the base portion (50) of the vane adjacent the rod body may be more narrow than the vane at the outside wear surface. This feature permits even greater fluid bypass area and makes the convergent taper surfaces (48) more aerodynamic. It may also be seen that convergent surface edge (52) may also be conveniently rounded. In fact, if desired, the degree of roundness of convergent surface edge may be such that to cause the semi-pyramid shaped structure on the terminal end of the vane to more closely resemble a semi-cone.

It is a feature of the present invention for the L/D ratio to be between about 2.1 to 3.5. Because of the variation of rounded edges (40), it has been found convenient to simply define the vane length (L) to be the length of the vane at the diameter (56) of the standard full size coupling which couples the rods. The diameter of couplings (20) may vary depending upon the size of the rod connected. Typically, a ⅝" rod is coupled with a standard connector having an outer diameter of about 1.5 inches. A ¾" rod is coupled with a 1⅝" standard connector, a ⅞" rod with a 1 13/16" standard connector and a rod with a 2 13/16" standard connector. A vane, having a terminal end like FIG. 3 or 5, will produce a vane length (L) only a little greater (10–15%) than the length of the outside wear surface.

Below is set forth a table which shows the drag coefficients ($C_d$) at varying fluid velocities $V_{(max)}$, for prior art rod guides on ¾" rods and a rod guide of the present invention.

Three prior art guides were compared to a guide of the present invention substantially identical to FIG. 2. Prior art guide TB is a standard guide, common in the industry, produced by J. M. Huber Corporation and sold under the trademark TURBULENCE BREAKER. This guide is very similar to the guide of German Patent 3130580 to Ebenhoh, with an L/D ratio of 1.7 and an erodible volume of 2.29 cubic inches. Prior art guide DP is a commercially available guide substantially identical to U.S. Pat. No. 4,809,777 to Sable and sold under the trademark DOUBLE PLUS. This guide purports to have the least fluid drag of any guide available. Comparative guide RC is a field installed guide substantially as described in U.S. Pat. No. 3,399,730 to Pourchot, manufactured by J. M. Huber and sold under the trademark RC. It is clear from the graph of FIG. 7 and the drag coefficients of Table 1 that the guide of the present invention significantly reduces the drag contributed by a rod guide to a rod string without sacrifice of erodible volume.

TABLE I

| | Cross Section (%) | L/D | Erod. Vol. ($in^3$) | $V_{(max)}$ (ft/min) | Cd |
|---|---|---|---|---|---|
| 2½" TB | 64% | 1.25 | 2.29 | 156 | 0.91 |
| | | | | 195 | 0.80 |
| | | | | 233 | 0.71 |
| | | | | 272 | 0.75 |
| | | | | 311 | 0.77 |
| | | | | 350 | 0.79 |
| | | | | 389 | 0.75 |
| 2½" DP | 61% | 1.17 | 3.80 | 156 | 0.92 |
| | | | | 195 | 0.88 |
| | | | | 233 | 0.82 |
| | | | | 272 | 0.85 |
| | | | | 311 | 0.84 |
| | | | | 350 | 0.85 |
| | | | | 389 | 0.86 |
| 2½" RC | 78% | 2.02 | 4.75 | 156 | 4.65 |
| | | | | 195 | 4.00 |
| | | | | 233 | 3.76 |
| | | | | 272 | 3.46 |
| | | | | 311 | 3.32 |
| | | | | 350 | 3.22 |
| | | | | 389 | 3.12 |
| 2½" FIG. 2 | 56.5% | 2.7 | 3.84 | 156 | 0.63 |
| | | | | 195 | 0.57 |
| | | | | 233 | 0.62 |
| | | | | 272 | 0.65 |
| | | | | 311 | 0.67 |
| | | | | 350 | 0.66 |
| | | | | 389 | 0.66 |

It may be seen from the above table, for the guide of the present invention, the drag coefficient is substantially constant as the linear velocity of the passing fluid varies as compared to guides of the prior art. This constancy of drag coefficient suggests that fluid movement past the guide approaches laminar flow and therefore, turbulence and drag is reduced. It should be remembered that drag coefficients decrease as velocities increase or as flow rates move from laminar through the transition zones into turbulent regions. Eventually, drag coefficients will become constant as the flow rate moves further into the turbulent range or as the Reynolds number exceeds $10^4$. Disjointed results are possible in transition zones between laminar and turbulent flow.

Again, it is a feature of the present invention that this reduced drag coefficient is obtained without loss of erodible volume. It should be noted that a guide of the present invention substantially in the form of FIG. 2 actually has a greater erodible volume than prior art comparative examples DP or TB. Comparative guide RC gains erodible volume only at the expense of increased cross-sectional area.

It is another feature of the present invention that the cross-sectional area of the guide is kept as low as practical. Table I illustrates that for similar diameter guides the cross section of FIG. 2 guide is significantly less than the others without loss of erodible volume. Cross sectional area is the area occupied by the guide as a percent of the area encompassed by its selected diameter.

It should be noted that for guides of the present invention, the cross-sectional area should be between 64–67% for a nominal 2" guide (i.e. for use with 2" ID tubing), 54–60% for a 2½" guide and 47–52% for a 3" guide. The selected diameter for a guide is slightly less than the tubing ID for which it is intended.

Figure 7:
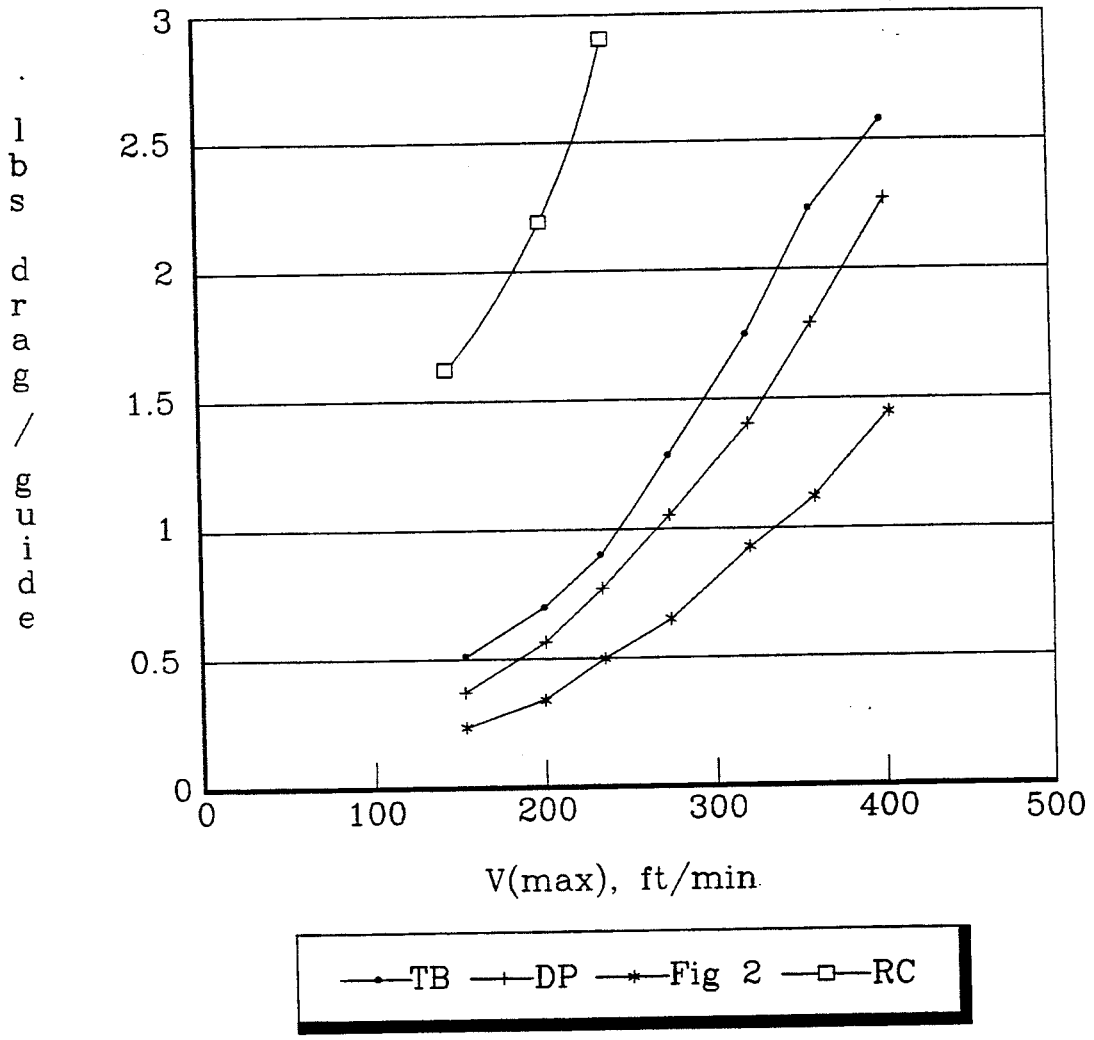
FIG. 7 is a graphic illustration depicting drag force per guide at different flow velocities.

Referring now to FIG. 7, there may be seen a graph which depicts the relation between velocity of fluid past a guide in a tube, $V_{(max)}$, and the axial force exerted upon the guide by the moving fluid, lbs. drag/guide.

The foregoing description of the invention is explanatory only and changes in the details of construction illustrated may be made those skilled in the art within the scope of the appended claims, without departing from the spirit of the invention.

What is claimed is:

1. An improved sucker rod guide for fixedly engaging around a sucker rod at a selected location along the length of the rod, the rod guide comprising:

a substantially cylindrical polymeric body having a longitudinal axis, a terminal end substantially continually tapered to the rod, a radially-inward surface and a radially outward surface, the radially inward surface of the body adjacent to and in gripping engagement with the rod when the rod guide is fixedly engaged around the rod; and a plurality of substantially continuous, longitudinal vanes carried by the body, a vane having a selected length and width, and longitudinally disposed along the radially outward surface of the guide body, extending radially away from the guide body and having a radially outside wear surface, the plurality of wear surfaces establishing a selected diameter, the length of the vane being at least substantially 2.1 times the diameter of the plurality of wear surfaces and 5–14 times the selected width of the vanes, the body and plurality of vanes having a cross-sectional area, expressed as a percent of the area encompassed by the selected diameter, of less than 70%.

2. The rod guide of claim 1 wherein the plurality of vanes includes three radially extending vanes circumferentially disposed substantially 120° about the guide body wherein the length of a vane is 5–12 times the selected width of the vane.

3. The rod guide of claim 2 wherein the length of a vane is 6.5–10 times the selected width.

4. The rod guide of claim 3 wherein the length of a vane is 7.5–8.5 the selected width.

5. The rod guide of claim 3 wherein the length of a vane is substantially 2.2–3 times the selected diameter.

6. The rod guide of claim 1 wherein the plurality of vanes includes four radially extending vanes circumferentially disposed substantially 90° about the guide body, a vane having a length 7–14 times the selected width.

7. The rod guide of claim 6 wherein the length of a vane is 9–11 times the selected width.

8. The guide of claim 7 wherein the length of a vane is substantially 10 times the selected width.

9. The rod guide of claim 7 wherein the length of a vane is substantially 2.2–3 times the selected diameter.

10. The rod guide of claim 1 wherein the length of a vane is substantially 2.2–3 times the selected diameter.

11. The rod guide of claim 10 wherein the length of a vane is substantially 2.7 times the selected diameter.

12. The rod guide of claim 1 further comprising:

a substantially continuous leading surface on a terminal end of a vane connecting the wear surface with the tapered terminal end of the body, the leading surface forming a substantially mono-planar face from the wear surface to the rod.

13. The rod guide of claim 12 wherein the substantially mono-planar face of the leading surface establishes an average angle approximately between 25 and 45 degrees to the axis of the body.

14. A rod guide of claim 1 wherein the leading surface of a vane forms a single plane from the wear surface to the rod.

15. The rod guide of claim 14 wherein the plane of the leading surface establishes an angle between 25 and 45 degrees to the axis of the body.

16. The rod guide of claim 12 wherein a terminal end of a vane is substantially semi-pyramidic with inwardly conveying vane side surfaces.

17. The rod guide of claim 16 wherein an edge formed by the intersection of an inwardly converging side surface with a leading surface is rounded to reduce turbulence.

18. The rod guide of claim 12 wherein an edge formed by the intersections of a leading surface with a wear surface and an edge formed by the intersection of the leading surface with the side surface is rounded to reduce turbulence.

19. The rod guide of claim 12 wherein a vane includes a base portion adjacent the guide body having a base width, the base width is less than the selected width of the vane at the outside wear surface.

20. The rod guide of claim 1 wherein the cross-sectional area is between 64 and 67 percent and the diameter is less than substantially 2 inches.

21. The rod guide of claim 1 wherein the cross-sectional area is between 54–60 percent and the diameter is less than substantially 2½ inches but greater than 2 inches.

22. The rod guide of claim 1 wherein the cross-sectional area is between 47–52 percent and the diameter is less than substantially 3 inches but greater than 2½ inches.

23. An improved sucker rod guide for fixedly engaging around a sucker rod at a selected location upon the length of the rod, the rod guide comprising:

a substantially cylindrical polymeric body having a longitudinal axis, a terminal end substantially continually tapered to the rod, a radially inward surface and a radially outward surface, the radially inward surface of the body adjacent to and in gripping engagement with the rod when the rod guide is fixedly engaged about the rod;

four substantially continuous, longitudinal vanes carried by the body, each vane having a selected length and width and longitudinally disposed along the radially outward surface of the guide body, extending radially away from the guide body and having a radially outside wear surface;

a substantially continuous leading surface on a terminal end of each vane connecting the wear surface with the tapered terminal end of the body, the leading surface forming a substantially monoplanar face from the wear surface to the rod; and the wear surfaces of the vanes establishing a selecting diameter, the length of each vane being at least substantially 2.2–3 times the selected diameter of the wear surfaces and 9–11 times the selected width of the vanes.

24. The rod guide of claim 23 wherein the substantially monoplanar face of the leading surface establishes an average angle approximately between 25–35 degrees to the axis of the body.

25. An improved sucker rod guide for fixedly engaging around a sucker rod at a selected location along the length of the rod, the rod guide comprising:

longitudinal axis, a terminal end substantially continually tapered to the rod, a radially inward surface and a radially outward surface, the radially inward surface of the body adjacent to and in gripping engagement with the rod when the rod guide is fixedly engaged around the rod;

three substantially continuous, longitudinal vanes carried by the body, and circumferentially disposed substantially 120° about the guide body, each vane having a selected length and width and longitudinally disposed along the radially outward surface of the guide body, extending radially away from the guide body and having a radially outside wear surface;

a substantially continuous, leading surface on a terminal end of each vane connecting the wear surface with the tapered terminal end of the body, the leading surface forming a substantially monoplanar face from the wear surface to the rod; and the wear surfaces of the vanes establishing a selected diameter, the length of each vane being at least substantially 2.2–3 times the selected diameter and 6.5–10 times the selected width of the vanes.

26. The rod guide of claim 25 wherein the substantially monoplanar face of the leading surface establishes an average angle approximately between 25–35 degrees to the axis of the body.

* * * * *